US005590440A

United States Patent [19]

Pelt et al.

[11] Patent Number: 5,590,440

[45] Date of Patent: Jan. 7, 1997

[54] GRAB BAR ASSEMBLY

[75] Inventors: Thomas E. Pelt, Menomonee Falls; Thomas G. Barnum, Fox Point, both of Wis.

[73] Assignee: Bradley Corporation, Menomonee Falls, Wis.

[21] Appl. No.: 409,315

[22] Filed: Mar. 23, 1995

[51] Int. Cl.[6] ..... A47B 95/02

[52] U.S. Cl. ..... 16/111 R; 16/112; 16/342; 16/50

[58] Field of Search ..... 16/111 R, 112, 16/126, 110 R, 286, 289, 256, 290, 291, 342, 338, 337, 339; 211/100; 4/254, 576.1, 577.1, 611; 5/662, 642

[56] References Cited

U.S. PATENT DOCUMENTS

| | | | |
|---|---|---|---|
| 325,761 | 9/1885 | Niles . | |
| 636,322 | 11/1899 | Danielson . | |
| 720,254 | 2/1903 | Keene . | |
| 1,131,659 | 3/1915 | Bommer . | |
| 1,282,588 | 10/1918 | Keene . | |
| 1,779,738 | 10/1930 | Johnson . | |
| 2,814,049 | 11/1957 | Mercur . | |
| 3,999,246 | 12/1976 | Suska . | |
| 4,073,038 | 2/1978 | Curry et al. | 16/50 |
| 4,539,727 | 9/1985 | Mautner et al. . | |
| 4,657,233 | 4/1987 | Vroom . | |
| 4,908,906 | 3/1990 | Hanna . | |
| 4,982,453 | 1/1991 | Matsumoto | 16/342 |
| 5,142,738 | 9/1992 | Ojima | 16/342 |

*Primary Examiner*—Chuck Y. Mah
*Attorney, Agent, or Firm*—Foley & Lardner

[57] ABSTRACT

A grab bar assembly for assisting persons between a seated and standing position is disclosed. The assembly includes a framework having a base plate and a housing. A pivot shaft and coil spring are mounted within the housing. The spring is affixed at one end with respect to the stationary housing and is connected at its other end to the pivot shaft. A swing arm is disposed over the housing and affixed to at least one end of the pivot shaft and a grab bar is connected to the swing arm. The grab bar is designed to permit a user to grasp the bar and pivot it about the stationary cylindrical housing between a stored position and an in-use position.

20 Claims, 2 Drawing Sheets

GRAB BAR ASSEMBLY

FIELD OF THE INVENTION

This invention relates generally to a grab bar assembly that may be used to assist a person in moving between a seated and a standing position, and particularly to a grab bar connected to a spring loaded hinge that biases the grab bar along a generally vertical plane towards a stored position.

BACKGROUND OF THE INVENTION

A variety of grab bar assemblies are presently available for assisting users between seated and standing positions. Often, those grab bars are placed in environments such as restrooms to help handicapped or elderly persons to move between a standing and a seated position. Many of the present devices use stationary bars that are bolted or otherwise attached to a wall and disposed where the person using the device may grasp the bar with his or her hands to facilitate movement between the seated and standing positions. Other devices use pivots or a combination of pivots and springs to permit movement of the grab bar from a stored location to a location proximate the user to save space yet render the device accessible to the user.

The simple fixed grab bars are adequate in many situations, but they can be obstructive and actually hinder movement of the user, particularly when placed in environments having limited space. Other devices that can be pivoted either vertically or horizontally can prove to be less stable or may also be difficult to store.

Some grab bar assemblies use a spring, such as a coil spring, to bias the grab bar to a stored position. For example, one type of grab bar is connected to a base by a pivot shaft and incorporates a coil spring to bias the grab bar upwardly to a generally vertical stored position along the wall. However, the user may grasp the bar and pull it downwardly to a generally horizontal position where the bar is held in that position by gravitational force. Thus, the person may use the bar for assistance in moving between seated or standing positions and then lift the bar with the aid of the coil spring to the vertical stored position. One problem with conventional devices of this type is the complexity of the spring mechanism that renders the assembly more complex and more expensive to manufacture.

It would be advantageous to provide a grab bar assembly having an easily usable grab bar and a simple, dependable spring hinge capable of holding the grab bar in a stored position.

SUMMARY OF THE INVENTION

The present invention features an apparatus and method for assisting a person in moving between a seated and a standing position. The apparatus includes a grab bar that may be gripped by the person. The assembly also includes a base plate adapted to be attached to a wall, and a cylindrical housing attached to the base plate and having a pair of open ends. A shaft is pivotably mounted within the cylindrical housing to pivot about a longitudinal axis. Also disposed within the cylindrical housing, a spring has a first end connected to the shaft and a second end affixed with respect to the cylindrical housing to permit biasing of the shaft with respect to the cylindrical housing. A swing arm is connected to the grab bar and has a pair of ends adapted to be disposed adjacent the open ends of the cylindrical housing. The swing arm is connected to the shaft in a manner that places greater tension on the spring as the grab bar and the swing arm are pivoted in one direction. This allows the spring to bias the grab bar in the opposite direction, for instance, an upward direction that moves the grab bar to a stored position.

The present invention is also directed to a method for providing assistance to a person moving between a seated and a standing position. The method generally comprises the steps of constructing a base plate for mounting along a wall and attaching a cylindrical housing to the base plate. Additional steps include inserting a pivot shaft into the cylindrical housing and affixing an end of a spring with respect to the cylindrical housing while connecting the other end of the spring to the pivot shaft. Additional steps include mounting a swing arm over the cylindrical housing, the swing arm being designed with a pair of ends at least one of which is non-rotatably connected to the pivot shaft. A grab bar is also provided to extend from the swing arm giving the user multiple grasping surfaces for assistance in moving between the seated and the standing position.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENT

Figure 1:
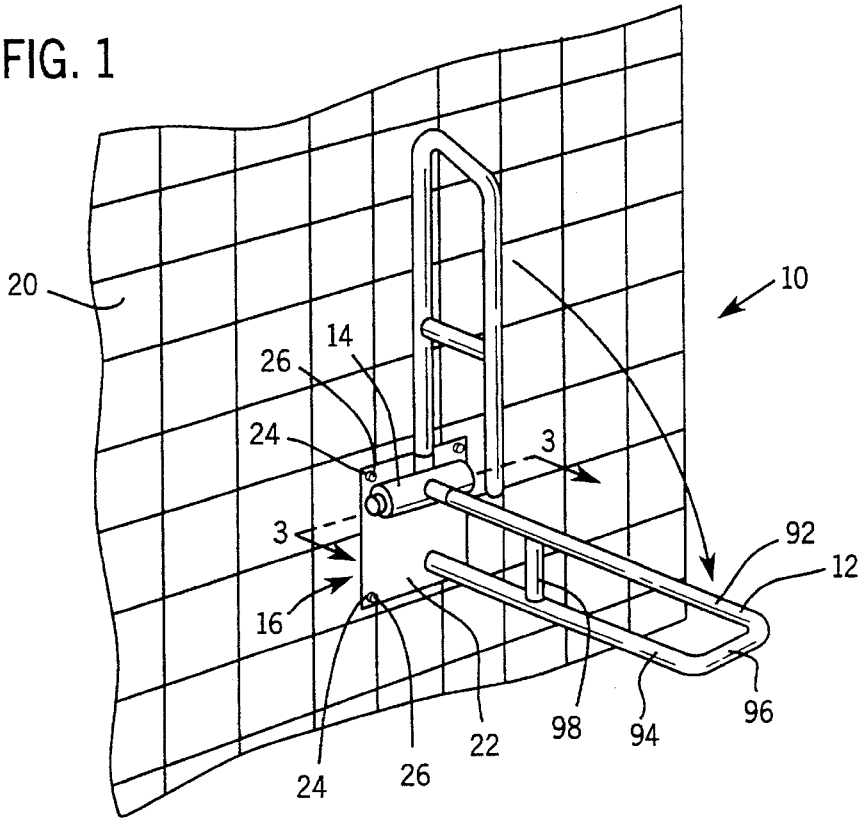
FIG. 1 is a perspective view of a grab bar assembly according to a preferred form of the present invention.
Figure 3:
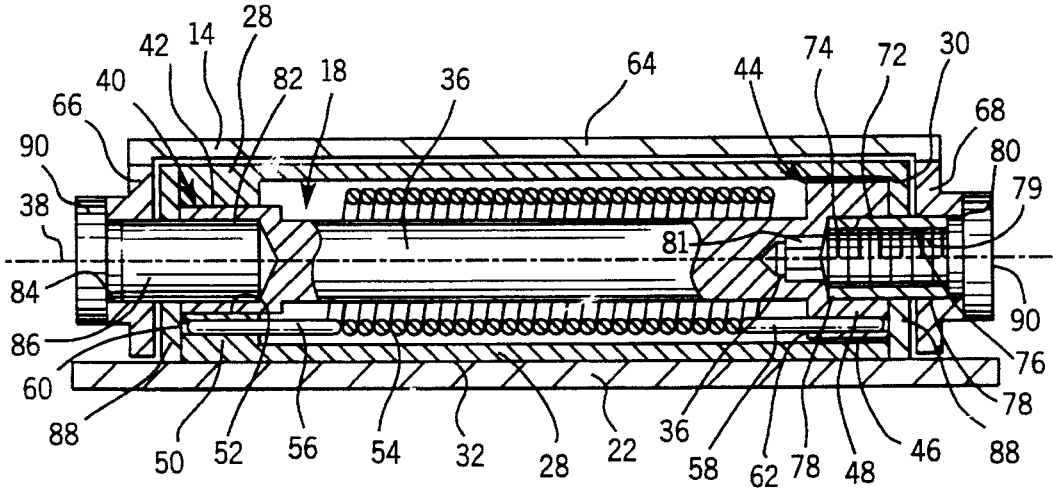
FIG. 3 is a cross-sectional view taken generally along line 3—3 of FIG. 1.
Figure 2:
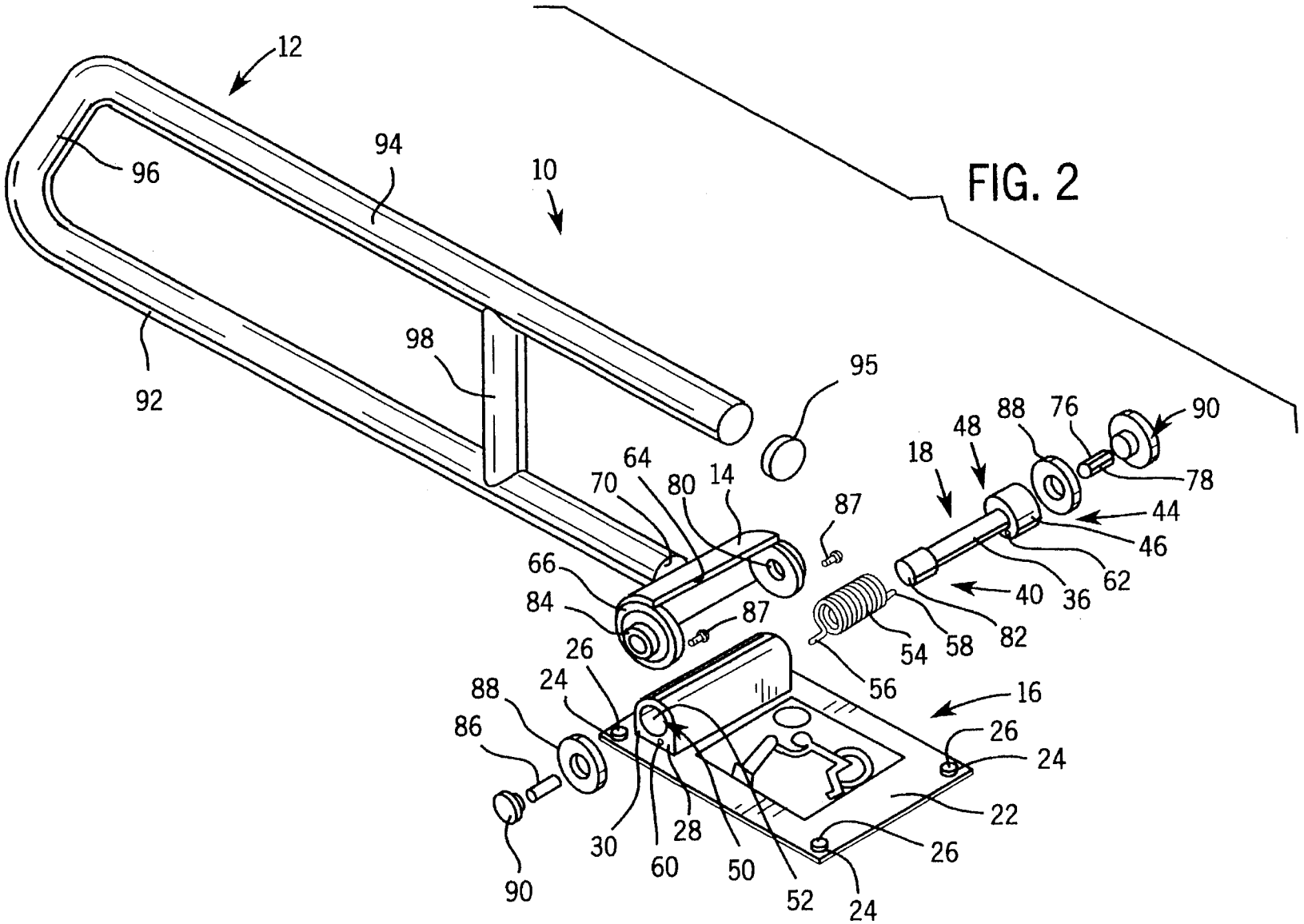
FIG. 2 is an exploded view of the grab bar assembly illustrated in FIG. 1.

Referring generally to FIGS. 1–3, a grab bar assembly 10 is illustrated. As shown in FIG. 1, grab bar assembly 10 is preferably oriented for pivotable movement along a generally vertical plane between a substantially vertical stored position and a substantially horizontal in-use position when being used for assistance by a person moving between a seated and standing position. The stored and in-use positions are both shown in FIG. 1. However, it is well within the knowledge of one of ordinary skill in the art to orient the assembly for movement along other planes, including generally horizontal planes.

Grab bar assembly 10 includes a grab bar 12, a swing arm 14, a framework 16 and a pivot shaft assembly 18 (see FIG. 2). Framework 16 is preferably configured for mounting along a wall 20, and grab bar 12 combined with swing arm 14 is connected to framework 16 via pivot shaft assembly 18. Those components are arranged to preferably permit pivot shaft assembly 18 to bias grab bar 12 in an upward direction towards its vertical stored position. However, the bias should not be so great as to prevent the weight of grab bar 12 from maintaining it in its generally horizontal position during use. Preferably the bias is of such magnitude to prevent precipitous drop from the stored or intermediate positions, while permitting grab bar 12 to remain at the horizontal position. Grab bar assembly 10 could be designed to incorporate a latch for holding the grab bar in its usable position rather than relying on gravity, however gravity is preferred because it permits a simpler and more usable design.

Referring to the specific components, framework 16 preferably includes a base plate 22 adapted for attachment to wall 20 by, for instance, a plurality of mounting holes 24 through which fasteners 26, such as bolts or screws. The bolts or screws may be inserted through mounting holes 24 and threaded into wall 20. Framework 16 also includes a housing 28 having a hollow interior that extends between a pair of open ends 30. Housing 28 may be attached to base plate 22 in a variety of ways, but it is preferred that housing 28 be cast with a flat surface 32 oriented adjacent base plate 22 to ease mounting by welding, bolts, or adhesive.

Pivot shaft assembly 18 is substantially disposed within the interior of housing 28 for pivotable or rotatable motion with respect to housing 28. In the preferred embodiment, pivot shaft assembly 18 includes a pivot shaft 36 that is mounted within housing 28 for pivotable motion about a longitudinal axis 38 (see FIG. 3).

Pivot shaft 36 includes a first end 40 having a bearing surface 42 and a second end 44 having a bearing surface 46. Pivot shaft 36 includes a fixed bushing region 48 disposed at second end 44. Bearing surface 46 forms the radially outward surface of fixed bushing region 48 and therefore bearing surface 46 preferably has a larger diameter than bearing surface 42. A bushing region 50 having an aperture 52 therethrough may be affixed within the interior of cylindrical housing 28 towards one of the open ends 30 or it may be integrally formed with housing 28 as illustrated in FIGS. 2 and 3. Aperture 52 is sized to rotatably receive bearing surface 42 of pivot shaft 36. Thus, when pivot shaft 36 is inserted into the interior of housing 28, bearing surface 42 rotates within aperture 52 proximate one of the open ends 30 while bearing surface 46 on fixed bushing region 48 rotates within housing 28 towards the other open end 30.

Rotation of pivot shaft 36 within cylindrical housing 28 is affected by a spring 54. Spring 54 is affixed with respect to housing 28 at one end and is connected to pivot shaft 36 at the other end to bias the rotation of pivot shaft 36. In the illustrated embodiment, spring 54 is a coil spring disposed about pivot shaft 36 between first end 40 and second end 44. Spring 54 includes a first extended end 56 and a second extended end 58. As illustrated, first extended end 56 is preferably held in a retainer aperture 60 disposed longitudinally in bushing region 50 of housing 28 radially outward from aperture 52. Second extended end 58 is held in a retainer aperture 62 disposed longitudinally in fixed bushing region 48 radially inward from bearing surface 46. Thus, when spring 54 is connected between pivot shaft 36 and housing 28 via retainer apertures 60 and 62, rotation of pivot shaft 36 in one direction, e.g. the direction resulting from downward movement of grab bar 12, winds spring 54 and creates a rotational bias against pivot shaft 36 in the opposite direction. Preferably, spring 54 is prewound to provide sufficient biasing force to also hold grab bar 12 in its stored position.

Swing arm 14 is affixed to pivot shaft 36 and winds spring 54 as it is pivoted or rotated about the outside of housing 28. Specifically, swing arm 14 includes an arcuate plate 64 that rotates around a portion of the exterior of housing 28 as grab bar 12 is pivoted between the stored and in-use positions. A first end plate 66 and a second end plate 68 are connected to arcuate plate 64 and extend generally transversely therefrom. First and second end plates 66 and 68 are disposed at sufficient distance from one another to generally fit over housing 28 adjacent open ends 30. A mounting stem 70 is affixed to arcuate plate 64 and extends outwardly therefrom in a direction generally opposite end plates 66 and 68.

Swing arm 14 is connected to pivot shaft 36 by connecting at least one of the end plates 66 or 68 to a corresponding pivot shaft end 40 or 44. In the preferred embodiment, pivot shaft 36 includes a recessed region 72 (see FIG. 3) disposed in second end 44, preferably parallel to longitudinal axis 38. Recessed region 72 includes an internal wall 74 having a predetermined shape, such as a hexagonal shape (see FIG. 3). A pin 76 is connected to end plate 66 or 68 in a non rotatable manner and includes an outer wall 78 having a configuration (e.g. hexagonal) that prevents rotation of pin 76 with respect to pivot shaft 36 when inserted into recessed region 72. Preferably, end plate 68 also includes an aperture 80 having a predetermined configuration such as a hexagonal configuration. Thus, pin 76 may be inserted through aperture 80 and into recessed region 72 to prevent rotation of swing arm 14 with respect to pivot shaft 36.

As illustrated in FIG. 3, pin 76 may include an at least partially threaded aperture 79 therethrough. Threaded aperture 79 serves at least two functions; the first is to permit insertion therethrough of an internal hex wrench (not shown) for cooperation with a socket 81 formed in pivot shaft 36; the second is to permit an appropriately sized bolt to be threaded into the aperture to facilitate removal of pin 76. Socket 81 permits winding of spring 54 prior to insertion of pin 76 as more fully described below.

In the most preferred embodiment, first end 40 of pivot shaft 36 also includes a recessed region 82 that extends inwardly along longitudinal axis 38. First end plate 66 includes a corresponding aperture 84 through which a pin 86 maybe inserted. Thus, pin 86 can be inserted into recessed region 82 of pivot shaft 36 through corresponding aperture 84 in first end plate 66. Pin 86 may have a contoured exterior surface like pin 76 or it may have a cylindrical exterior surface to hold end plate 66 with respect to first end 40 of pivot shaft 36. It should also be noted that pin 76 and the corresponding inner wall 74 of predetermined configuration could be disposed in either end of pivot shaft 36.

Additionally, a pair of washers 88 may be disposed between housing 28 and end plate 66 and 68 respectively. A pair of end caps 90 are disposed in the outer portions of aperture 80 and corresponding aperture 84, respectively, for aesthetic reasons and to help retain pins 76 and 86 within recessed regions 72 and 82. End caps 90 are preferably held in place by a pair of set screws 87 as illustrated in FIG. 2.

Grab bar 12 is connected to mounting stem 70 to pivot with swing arm 14 about housing 28. The illustrated embodiment of grab bar 12 includes a first leg 92 and a second leg 94. First leg 92 and second leg 94 are connected, preferably, at a distal end by a crossover member 96. Additionally, grab bar 12 may include at least one reinforcement strut 98 connected between first leg 92 and second leg 94 intermediate crossover member 96 and swing arm 14. As illustrated, first leg 92, second leg 94, cross over member 96, and reinforcement strut 98 may comprise cylindrical tubing. Preferably, first leg 92 is connected to mounting stem 70 by, for instance, welding and second leg 94 is disposed generally below first leg 92 when grab bar 12 is in its generally horizontal in-use position. The end of second leg 94 is capped by an end cap 95 as illustrated in FIG. 2.

Pivot shaft 36 is typically prewound prior to insertion of pin 76 which holds swing arm 14 to pivot shaft 36. The spring is prewound a sufficient amount to provide a biasing force that tends to bias grab bar 12 towards the vertical stored position and maintains grab bar 12 in this vertical, stored position. Thus, grab bar 12 is securely held by spring 54 against wall 20. However, a person using grab bar assembly 10 may simply grasp grab bar 12 and pivot it downwardly until it is in its generally horizontal position, i.e. until second leg 94 comes to rest against base plate 22 and is held in this position by the weight of grab bar 12. Once the person using grab bar assembly 10 moves between a seated and standing position, the user may provide an upward force against grab bar 12 and spring 54 assists the user in lifting grab bar 12 to its generally vertical stored position.

The prewinding of spring 54 is facilitated by the unique design of pin 76 and pivot shaft 36. Spring 54 and pivot shaft 36 are initially inserted into the interior of housing 28. Spring end 56 is inserted into retainer aperture 60 of housing 28 and spring end 58 is inserted into retainer aperture 62 of pivot shaft 36. Washers 88 and swing arm 14 are then mounted over housing 28 and pin 86 is inserted into aperture 84. An appropriately sized hexagonal wrench is inserted through threaded aperture 79 of pin 76 and into socket 81, however pin 76 is maintained outside of hexagonal recessed region 72 of pivot shaft 36 and aperture 80 of end plate 68. Thus, pivot shaft 36 may be rotated by the wrench in the appropriate direction to properly prewind spring 54 and then held in place while hexagonal pin 76 is slid along the wrench, partially through aperture 80, and into recessed region 72 to hold spring 54 in its prewound state between housing 28 and pivot shaft 36.

It will be understood that the foregoing description is of a preferred exemplary embodiment of this invention and that the invention is not limited to the specific form shown. For example, the grab bar assembly may incorporate various styles of springs connected between the cylindrical housing and the pivot shaft. The housing may be connected to the base plate and the grab bar may be connected to the swing arm in various ways, including adhesives, welding, and fasteners, such as bolts and screws. The configuration of the grab bar may be changed, and a wide variety of materials, including metals and plastics, can be used to construct the various components of the apparatus as would be understood by one of ordinary skill in the art. These and other modifications may be made in the design and arrangement of the elements without departing from the scope of the invention as expressed in the appended claims.

What is claimed is:

1. A grab bar assembly that is attachable to a wall to assist a person to a standing position, comprising:

a grab bar to be grasped by the person;

a base plate adapted to be attached to the wall;

a housing attached to the base plate and having a pair of open ends;

a shaft pivotably mounted within the cylindrical housing to pivot about a longitudinal axis;

a spring disposed within the cylindrical housing, the spring having a first end connected to the shaft and a second end connected to the housing; and a swing arm connected to the grab bar, the swing arm having a pair of ends adapted to be disposed adjacent the open ends, the swing arm being connected to the shaft.

2. The grab bar assembly as recited in claim 1, wherein one of the open ends of the housing includes a stationary bushing defining a bore to pivotably receive the shaft, the stationary bushing being disposed towards an end of the cylindrical housing and configured to receive the second end of the spring.

3. The grab bar assembly as recited in claim 2, wherein the spring is a coil spring disposed about the shaft.

4. The grab bar assembly as recited in claim 3, wherein the shaft includes a first end having a recess, the recess being defined by a wall of a predetermined configuration, further wherein a pin has a shaped end defined by an outer wall of the general predetermined configuration, the pin being affixed to one of the pair of ends of the swing arm and having its shaped end inserted into the recess.

5. The grab bar assembly as recited in claim 3, further comprising a pair of pins, wherein the shaft includes a pair of ends, each end having a recess configured to receive one of the pins, the pins also being connected to the swing arm.

6. The grab bar assembly as recited in claim 5, wherein at least one of the pins includes a contoured outer surface and one of the recesses is configured to receive the contoured outer surface and prevent rotation of the pin relative to the shaft, further wherein the shaft includes a recessed socket and at least one of its pins includes an aperture therethrough that cooperates with the socket.

7. The grab bar assembly as recited in claim 4, further comprising a plurality of washers, wherein at least one washer is disposed between each open end of the housing and each corresponding end of the swing arm.

8. The grab bar assembly as recited in claim 4, wherein the grab bar includes a first leg, a second leg, and a crosspiece connecting the first leg to the second leg.

9. The grab bar assembly as recited in claim 8, wherein the grab bar further includes a support strut connected between the first leg and the second leg.

10. The grab bar assembly as recited in claim 9, wherein the first leg is connected to the swing arm and the grab bar is disposed to move along a generally vertical plane when the swing arm is pivoted about the longitudinal axis.

11. A grab bar assembly attachable to a wall to assist a person in moving between a seated and a standing position, comprising:

a framework;

a pivot shaft having a first end and a second end and being rotatably mounted to the framework for pivotable motion about an axis that extends through the first and second ends;

a coil spring connected between the framework and the pivot shaft;

a swing arm connected to the first end and the second end of the pivot shaft for pivotable motion therewith; and a grab bar connected to the swing arm, the grab bar having at least two legs capable of being grasped by the person.

12. The grab bar assembly as recited in claim 11, wherein the framework includes a base plate and a single housing having open ends through which the axis extends and being adapted to receive the pivot shaft and coil spring.

13. The grab bar assembly as recited in claim 12, wherein the swing arm is connected to the pivot shaft by at least one contoured pin.

14. A method for providing assistance to a person moving from a seated to a standing position, comprising the steps of:

constructing a base plate for mounting along a wall;

attaching a housing having a generally hollow interior to the base plate;

inserting a pivot shaft into the housing;

connecting an end of a spring to the housing and connecting another end of the spring to the pivot shaft;

mounting a swing arm over the housing, the swing arm having a pair of ends at least one of which is connected to the pivot shaft; and providing a grab bar that extends from the swing arm to provide multiple grasping surfaces for the person.

15. The method as recited in claim 14, wherein the step of connecting the spring to the housing includes the step of inserting one end of the spring into a retainer aperture formed in the housing.

16. The method as recited in claim 15, wherein the step of mounting the swing arm includes the steps of forming a contoured recess in an end of the pivot shaft; forming a corresponding hole in one end of the swing arm; and inserting a pin into the contoured recess and the corresponding hole to prevent rotation of the swing arm with respect to the pivot shaft.

17. The method as recited in claim 14, further comprising the step of preloading the spring to bias the pivot shaft in a rotational direction with respect to the housing.

18. The method as recited in claim 17, further comprising the step of forming a stationary bushing within the housing, the stationary bushing having a hole therethrough for rotatably receiving the pivot shaft.

19. The method as recited in claim 15, wherein the step of mounting the swing arm includes the steps of forming a mounting hole in each end of the pivot shaft; forming a corresponding hole in each of the ends of the swing arms; and connecting the pivot shaft to the swing arm by inserting a pin into each mounting hole and corresponding hole.

20. The method as recited in claim 19, further comprising the steps of providing at least one pin with a contoured surface;

forming at least one mounting hole and corresponding hole with a configuration generally matching the contoured surface;

inserting the at least one pin into the at least one mounting hole and corresponding hole to prevent rotation of the swing arm with respect to the pivot shaft;

forming a socket in one of the ends of the pivot shaft; and forming an aperture through one of the pins and orienting the aperture to cooperate with the socket.

* * * * *